US006733257B2

(12) United States Patent
Ryu

(10) Patent No.: US 6,733,257 B2
(45) Date of Patent: May 11, 2004

(54) DUAL CYLINDER APPARATUS FOR RECIPROCAL HERMETIC COMPRESSOR

(75) Inventor: Ki-o Ryu, Cheonan (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 32 days.

(21) Appl. No.: 10/242,619

(22) Filed: Sep. 13, 2002

(65) Prior Publication Data

US 2003/0210998 A1 Nov. 13, 2003

(30) Foreign Application Priority Data

May 11, 2002 (KR) ..... 2002-26042

(51) Int. Cl.[7] ..... F04B 1/00
(52) U.S. Cl. ..... 417/526; 417/527
(58) Field of Search ..... 417/526, 523, 417/524, 525, 531, 534, 536, 552, 527, 528, 547, 543, 553; 91/422

(56) References Cited

U.S. PATENT DOCUMENTS 5,597,293 A * 1/1997 Bushnell et al. ..... 417/410.3
5,775,882 A * 7/1998 Kiyokawa et al. ..... 417/310
6,000,500 A * 12/1999 Oh ..... 184/6.16
6,276,911 B1 * 8/2001 Krusche et al. ..... 418/201.2
6,287,092 B1 * 9/2001 Calciolari et al. ..... 417/415
6,540,490 B1 * 4/2003 Lilie ..... 417/416

* cited by examiner

*Primary Examiner*—Justine R. Yu
*Assistant Examiner*—William H. Rodriquez
(74) *Attorney, Agent, or Firm*—Blank Rome LLP

(57) ABSTRACT

A dual cylinder apparatus for a reciprocal hermetic compressor with a cylinder body having two open ends. A pair of valve plate units are disposed at both ends of the cylinder body, and have refrigerant discharge holes formed therein. A pair of pistons are movably disposed in the cylinder body and reciprocate therein. A piston bar having one end connected to a connecting rod is slidably supported on the valve plate units and reciprocate thereon while supporting the pistons. The piston bar has a refrigerant discharge hole through which a refrigerant, located in between the pistons, is discharged outside the cylinder body. A discharge valve movably disposed between the pistons opens one gap between one of the pistons and the cylinder body and closes a second gap between the other piston and the cylinder body.

5 Claims, 3 Drawing Sheets

DUAL CYLINDER APPARATUS FOR RECIPROCAL HERMETIC COMPRESSOR

FIELD OF THE INVENTION

The present invention relates to a reciprocal hermetic compressor, and more particularly, to a dual cylinder apparatus for a reciprocal hermetic compressor.

BACKGROUND OF THE INVENTION

Generally, as shown in FIG. 1, a reciprocal hermetic compressor includes a motor unit 1 having a stator 2, a rotor 4 rotatably disposed around the stator 2, a crankshaft 6, a connecting rod 8 and a cylinder apparatus 10.

The crankshaft 6 is connected to and rotated with the rotor 4, and has an eccentric portion 6*a* formed at a lower portion. The eccentric portion 6*a* is connected to a large diameter portion 8*a* formed on an end of the connecting rod 8. A small diameter portion 8*b* is formed on the other end of the connecting rod 8, and is connected to a piston 9.

As shown in FIG. 2, the cylinder apparatus 10 includes a cylinder body 111 in which the piston 9 is reciprocally inserted, a cylinder head 13 provided on one side of the cylinder body 11, and a valve plate 15 disposed between the cylinder body 11 and the cylinder head 13. The valve plate 15 has a refrigerant discharge hole 15*a* which is opened and closed by a discharge valve 16, and a refrigerant suction hole 15*b* which is opened and closed by a suction valve 17.

In the above-described invention, the piston 9 is reciprocated by the movement of the connecting rod 8, which compresses and expands the refrigerant inside of a cylinder chamber 11*a*. When the piston 9 retreats, the suction valve 17 is opened and the discharge valve 16 is closed. Accordingly, the refrigerant is drawn into the cylinder chamber 11*a*. When the piston 9 advances, the suction valve 17 is closed and the discharge valve 16 is opened. As a result, the refrigerant inside of the cylinder chamber 11*a* is compressed and discharged.

The above structure is an example of a cylinder apparatus in which the refrigerant is drawn into and then discharged from the cylinder body 11 during every one rotation of the crankshaft 6. This type of cylinder apparatus has a relatively low efficiency and increased noise level due to the vibration and unbalanced refrigerant suction/discharge.

SUMMARY AND OBJECTS OF THE INVENTION

Accordingly, it is an object of the present invention to provide a cylinder apparatus for a hermetic compressor, having an improved structure in which refrigerant discharge and suction are performed twice during one rotation of a crankshaft.

The above object is accomplished by providing a dual cylinder apparatus for a reciprocal hermetic compressor comprising a cylinder body having two open ends with a pair of valve plate units disposed at both ends of the cylinder body, the valve plate units having refrigerant discharge holes formed therein. A pair of pistons are movably disposed in the cylinder body to reciprocate inside of the cylinder body. A piston bar having one end connected to a connecting rod is slidably supported on the valve plate units to reciprocate thereon while supporting the pistons. The piston bar includes a refrigerant discharge hole through which a refrigerant is discharged from in between the pistons to outside the pistons. A discharge valve is movably disposed between the pistons, the discharge valve opening a first gap between one of the pistons and the cylinder body and closing a second gap between the other piston and cylinder body.

The pair of pistons are connected to the piston bar at a predetermined distance from each other, with each having a diameter smaller than an inner diameter of the cylinder body.

The pair of valve plate units include valve plates connected at both ends of the cylinder body to close the ends, the valve plates having refrigerant discharge holes and suction valves disposed on their opposing inner surfaces to selectively open and close the refrigerant discharge holes, according to an advancement and a retreat of the pistons.

The discharge valve includes a pair of ring-type valves movably disposed between the pair of pistons in close contact with an inner surface of the cylinder body. Springs connect the ring-type valves such that the ring-type valves are moved closer or further away from each other by an external pressure. The ring-type valves are compressed during both the advancement and retreat of the pistons, opening the first gap between one of the pistons and an inner surface of the cylinder body, while closing the second gap between the other piston and inner surface of the cylinder body. Each ring-type valve has a diameter that is greater than the diameter of the pair of pistons so that the ring-type valve can seal the gap between the piston and the inner surface of the cylinder body.

BRIEF DESCRIPTION OF THE DRAWINGS

The above-mentioned objects and the feature of the present invention will be more apparent by describing the preferred embodiment of the present invention in detail referring to the appended drawings, in which.

DETAILED DESCRIPTION OF THE PREFERRED EMBODIMENT

The present invention will be described in greater detail with reference to the accompanying drawings.

Figure 1:
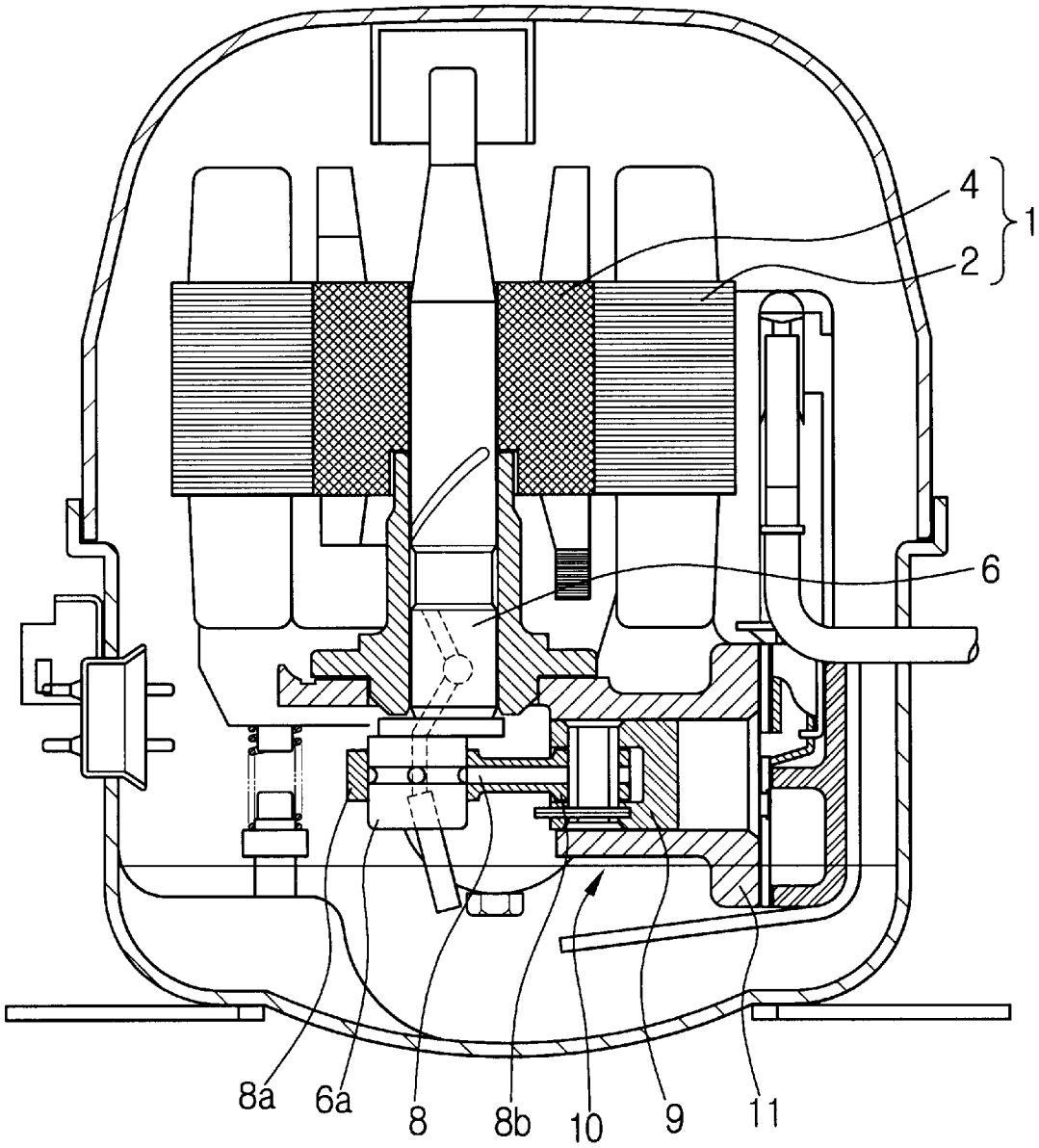
FIG. 1 (PRIOR ART)
FIG. 1 is a partial sectional view schematically showing a conventional hermetic reciprocal compressor.
Figure 2:
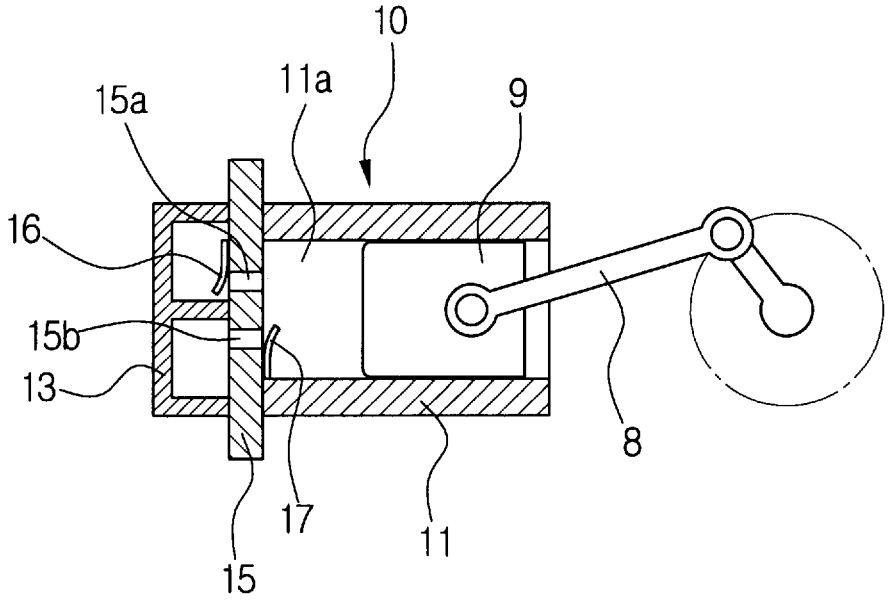
FIG.2 (PRIOR ART)
FIG. 2 is a sectional view showing a conventional cylinder apparatus.
Figure 3:
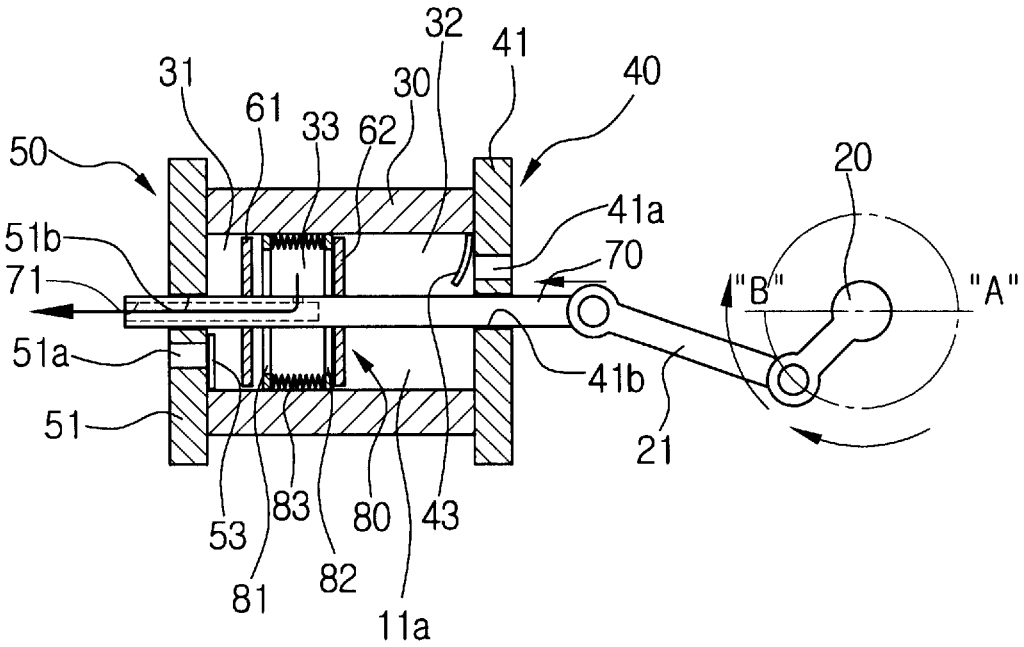
FIG. 3 is a sectional view showing a dual cylinder apparatus for a reciprocal hermetic compressor in a first position according to a preferred embodiment of the present invention.

Referring to FIG. 3, the dual cylinder apparatus according to the preferred embodiment of the present invention compresses and expands refrigerant twice during one rotation of a crankshaft 20. The cylinder apparatus includes a cylinder body 30 having two open ends, a pair of valve plate units 40, 50 disposed at the ends of the cylinder body 30, a pair of pistons 61, 62 disposed within the cylinder body 30, a piston bar 70 that reciprocates the pistons 61, 62 while maintaining the pistons 61, 62 at a predetermined distance, and a discharge valve 80 disposed between the pistons 61, 62.

The pair of valve plate units 40, 50 have valve plates 41, 51 connected at both ends of the cylinder body 30, the valve plates 41, 51 having guide holes 41*b*, 51*b* in which the piston bar 70 is slidably inserted. The valve plates 41, 51 have refrigerant suction holes 41*a*, 51*a* through which the refrigerant is drawn into the cylinder body 30, and suction valves 43, 53 covering the suction holes 41*a*, 51*a*. The suction valves 43, 53 are disposed inside of the valve plates 40, 50 to selectively open and close the refrigerant suction holes 41*a*, 51*a*. As the pistons 61, 62 advance or retreat, the suction valves 43, 53 open one of the refrigerant suction holes 41*a*, 51*a* while closing the other one of the refrigerant suction holes 41*a*, 51*a*.

Figure 4:
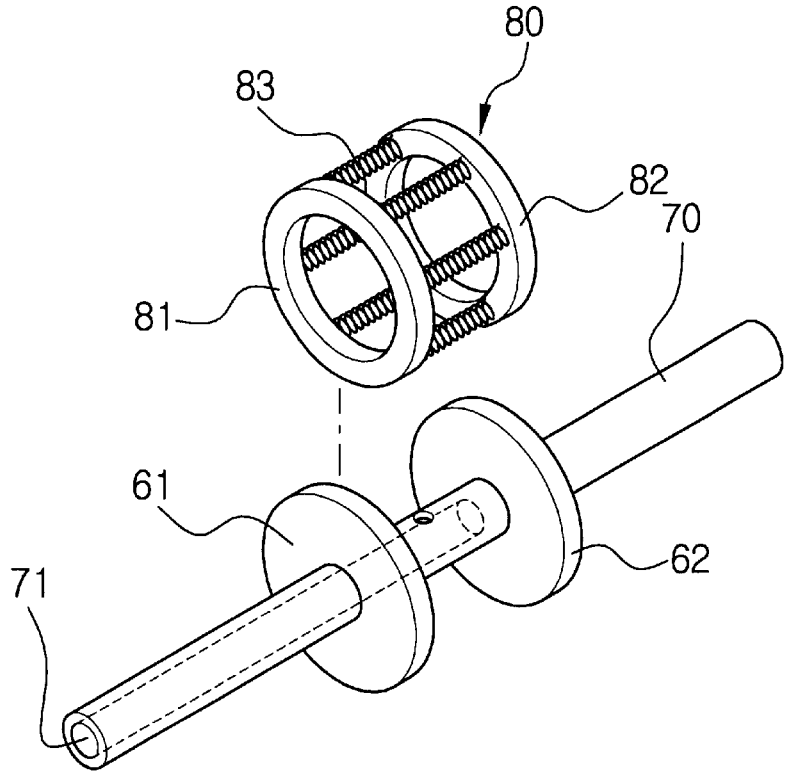
FIG. 4 is a perspective view showing a portion of FIG. 3.
Figure 5:
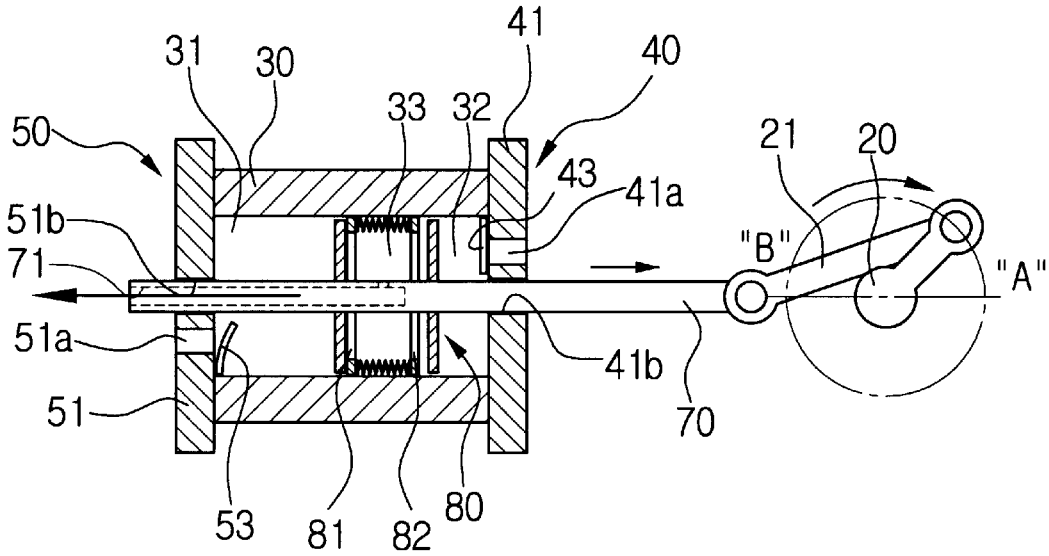
FIG. 5 is a sectional view showing a dual cylinder apparatus for a reciprocal hermetic compressor in a second position according to a preferred embodiment of the present invention.

The pair of pistons 61, 62 have a generally round like with a diameter smaller than the inner diameter of the cylinder body 30, so that there is a predetermined gap between each piston 61, 62 and an inner surface of the cylinder body 30, i.e., an inner wall of the cylinder chamber 11*a*. The gaps allow refrigerant to flow into and out of the space between the pistons. As shown in FIG. 4, the pistons 61, 62 are arranged at a predetermined distance from each other, and supported by the piston bar 70.

One end of the piston bar 70 is connected to a connecting rod 21 that converts a rotary movement of the crankshaft 20 into a linear movement of the piston bar 70. The piston bar 70 is slidably supported on the valve plates 41, 51 and passes through the cylinder body 30. The piston bar 70 has a refrigerant discharge hole 71 that connects the interior and exterior of the cylinder body 30 by forming a path from the middle portion of the piston bar 70 to its end. Accordingly, the refrigerant between the pistons 61, 62 can be discharged outside the cylinder body 30 through the refrigerant discharge hole 71.

A discharge valve 80 having first and second ring-type valves 81, 82 is movably disposed between the pair of pistons 61, 62. A plurality of springs 83 are connected between the first and second ring-type valves 81, 82 and allows them to move closer or further away from each other when an external pressure is applied.

Each of the ring-type valves 81, 82 have an outer diameter corresponding to the inner diameter of the cylinder body 30, so as to move in close contact with the inner surface of the cylinder body 30. The diameter of each ring-type valve 81, 82 is greater than the diameter of the pistons 61, 62 so that the gap between the pistons 61, 62 and the inner surface of the cylinder body 30, is selectively blocked. The springs 83 connect and support the ring-type valves 81, 82 so that the ring-type valves 81, 82 can be resiliently moved closer to or further away from each other.

The operation of the dual cylinder apparatus for the reciprocal hermetic compressor according to the preferred embodiment of the present invention is described below.

First, for purposes of explanation, the inside of the cylinder body 30, i.e., the cylinder chamber 11*a*, will be divided into a left and a right portion with respect to the pistons 61, 62 of FIG. 3. The left portion will be called a first cylinder chamber 31, while the right portion will be called a second cylinder chamber 32. The space between the pistons 61, 62 will be called a refrigerant discharge chamber 33. When the crankshaft 20 is rotated approximately 180° from position A to position B (FIG. 3), the connecting rod 21 connected to the crankshaft 20 converts the rotary movement of the crankshaft 20 into the linear reciprocal movement of the piston bar 70.

At this time, the piston bar 70 moves leftward, advancing the pistons 61, 62. Accordingly, the volume of the first cylinder chamber 31 decreases, and the pressure increases. By the increasing pressure in the first cylinder chamber 31, the first ring-type valve 81 is urged to the right in FIG. 3, and compresses the springs 83. As a result, a gap between the piston 61 and the cylinder body 30 is opened, and the compressed refrigerant of the first cylinder chamber 31 moves into the discharge chamber 33 and eventually out of the cylinder body 30 through the discharge hole 71.

As the refrigerant is discharged, the volume of the second cylinder chamber 32 increases, while the pressure decrease. Accordingly, the suction valve 43 is opened by the pressure difference, allowing the refrigerant to be drawn into the second cylinder chamber 32. At the same time, the springs 83 are compressed, causing the second ring-type valve 82 to engage the piston 62 and seal the gap between the piston 62 and the inner surface of the cylinder body 30. Therefore, the refrigerant flowing into the second cylinder chamber 32 is prevented from entering the discharge chamber 33. As described above, during this half rotation of the crankshaft 20, the refrigerant compression and expansion occurs inside of the cylinder body 30 almost simultaneously.

When the crankshaft 20 is rotated another 180° from position B to position A, the piston bar 70 is moved rightward, moving the pistons 61, 62 rightward. Accordingly, a process opposite to that shown in FIG. 3 occurs. Here, the first cylinder chamber 31 expands, opening the suction valve 53 and drawing in refrigerant into the first cylinder chamber 31 through the refrigerant suction hole 51*a*.

At the same time, the volume of the second cylinder chamber 32 decreases, the refrigerant compresses, and the pressure is increased. Because of the high pressure refrigerant, the second ring-type valve 82 moves to the left, as shown in FIG. 4, thereby compressing the springs 83. The gap between the piston 62 and the cylinder body 30 is opened and the compressed refrigerant of the second cylinder chamber 32 is allowed to move into the discharge chamber 30. The compressed springs 83 cause the first ring-type valve 81 to engage the piston 61, thereby sealing the gap between the piston 61 and the inner surface of the cylinder body. The refrigerant in the discharge chamber 33 is then discharged outside the cylinder body 30 through the discharge hole 71. As described above, when the crankshaft 20 moves from position B to position A, the refrigerant compression and expansion occurs inside of the cylinder body 30.

Therefore, as shown in FIGS. 3 and 4, the refrigerant is compressed and expanded twice during a full rotation of the crankshaft 20. Accordingly, the cylinder apparatus according to the present invention is twice as efficient as a conventional cylinder apparatus whose refrigerant is compressed and expanded only once during a full rotation of the crankshaft 20.

Also, since the refrigerant compression and expansion occurs at the left and right sides of the cylinder body 30 simultaneously, balance in cylinder operation is improved and a noise and vibration are decreased.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A dual cylinder apparatus for a reciprocal hermetic compressor, comprising:

a cylinder body having two open ends;

a pair of valve plate units disposed at both ends of the cylinder body, having refrigerant suction holes respectively formed therein;

a pair of pistons movably disposed in the cylinder body to reciprocate inside of the cylinder body;

a piston bar having one end connected to a connecting rod, and slidably supported on the valve plate units to reciprocate thereon while supporting the pistons, the piston bar having a refrigerant discharge hole through which a refrigerant is discharged from between the pistons to outside the cylinder body; and a discharge valve movably disposed between the pistons, the discharge valve opening a first gap between one of the pistons and the cylinder body and closing a second gap between the other piston and the cylinder body.

2. The dual cylinder apparatus of claim 1, wherein the pair of pistons are connected to the piston bar at a predetermined distance from each other, and having a diameter smaller than an inner diameter of the cylinder body.

3. The dual cylinder apparatus of claim 1, wherein the pair of valve plate units comprise:

valve plates connected to both ends of the cylinder body to close the ends, and having refrigerant discharge holes therein; and suction valves disposed on opposing inner surfaces of the valve plates to selectively open and close the refrigerant discharge holes according to an advancement and a retreat of the pistons.

4. The dual cylinder apparatus of claim 1, wherein the discharge valve comprises:

a pair of ring-type valves movably disposed between the pair of pistons, and movable in close contact with an inner surface of the cylinder body;

a spring for connecting the ring-type valves such that the ring-type valves are moved closer to or further away from each other by an external pressure; and wherein the discharge valve is compressed during an advancement and retreat of the pistons to open a gap between one of the pistons and the inner surface of the cylinder body, while closing a gap between the other piston and the inner surface of the cylinder body.

5. The dual cylinder apparatus of claim 4, wherein the ring-type valves have a diameter that is greater than the diameter of the piston.

* * * * *